US005440283A

United States Patent [19]

Nendza

[11] Patent Number: 5,440,283

[45] Date of Patent: Aug. 8, 1995

[54] INVERTED PIN DIODE SWITCH APPARATUS

[75] Inventor: Kenneth J. Nendza, Austin, Tex.

[73] Assignee: Sierra Microwave Technology, Georgetown, Tex.

[21] Appl. No.: 259,446

[22] Filed: Jun. 14, 1994

[51] Int. Cl.[6] ..... H01P 1/15

[52] U.S. Cl. ..... 333/262; 333/247

[58] Field of Search ..... 333/103, 104, 81 A, 333/81 R, 262

[56] References Cited

U.S. PATENT DOCUMENTS

| | | | |
|---|---|---|---|
| 2,959,778 | 11/1960 | Bradley . | |
| 3,475,700 | 12/1969 | Ertel | 333/104 |
| 3,503,014 | 3/1970 | Hall et al. | 333/104 |
| 3,720,888 | 3/1973 | Manuali | 333/103 |
| 3,750,055 | 7/1973 | Funck . | |
| 3,768,025 | 11/1973 | Hreha . | |
| 3,909,751 | 8/1975 | Tang et al. | 333/103 |
| 4,222,066 | 9/1980 | Zelenz | 333/262 X |
| 4,267,538 | 5/1981 | Assal et al. | 333/262 |
| 4,525,863 | 6/1985 | Stites | 455/83 |
| 4,763,089 | 8/1988 | Pon | 333/202 |
| 4,823,096 | 4/1989 | Hash | 333/109 |
| 5,034,708 | 7/1991 | Adamian et al. | 333/161 |
| 5,193,218 | 3/1993 | Shimo | 455/80 |

OTHER PUBLICATIONS

Sierra Microwave Technology Catalogue Series 90 Millimeter Wave SPST Switches, p. 145.

Series 90 SPST Switches Specification, p. 146.

*Primary Examiner*—Paul Gensler

*Attorney, Agent, or Firm*—Shaffer & Culbertson

[57] ABSTRACT

The present invention describes a switch (10) designed primarily for use in the radio frequency and microwave spectrums. The switch (10) of the present invention uses a lumped element network (16), PIN diodes (18), and capacitive elements (20) to provide isolation in an "open" position wherein the PIN diodes (18) are forward biased. In a "closed" position, wherein the PIN diodes are not forward biased, signals propagate through the switch (10) unhindered because the input impedance of the lumped element network (16) substantially matches the characteristic impedance of transmission line segments (12 and 14) that provide input and output paths to the lumped element network (16).

3 Claims, 3 Drawing Sheets

INVERTED PIN DIODE SWITCH APPARATUS

BACKGROUND OF THE INVENTION

This invention relates to microwave switching devices. More particularly, this invention relates to an inverted PIN diode switch that does not use PIN diodes or DC blocking capacitors as series elements in the signal path and that does not require one-quarter wavelength tuning elements to transform impedances within the switch.

For many years, switches have been used in the electrical arts to provide a means for isolating a portion of an electrical circuit. In its simplest form, a single pole/-single throw switch resides in one of two positions. In a "closed" position, the switch allows a signal to pass from an input port to an output port. In an "open" position, the switch prevents a signal from passing from the input port to the output port. A theoretically perfect switch has no series impedance or shunt admittance in the "closed" position and has either infinite series impedance, infinite shunt admittance, or both in the "open" position.

The earliest switches had mechanical contacts and were manually switched from the "open" position to the "closed" position and back again. Since that time, mechanical switches have been improved to operate automatically and remotely and are still used for many applications. In the particular application to microwave signals in the 12 to 40 Gigahertz range, however, mechanical switches operate too slowly for most applications. Further, since all mechanical switches fail over time due to the breakage of the moving parts, mechanical switches are inappropriate where complete reliability is required.

In response to the shortcomings of mechanical switches, the solid-state switch was developed. Solid state switches have no moving parts and last indefinitely. The solid state switches use semiconductor devices in a variety of configurations to provide the "open" and "closed" positions and often employ PIN diodes as their controllable elements. PIN diodes, as is well known, are diodes that are formed from a silicon wafer containing nearly equal P type and N type impurities. P type impurities are diffused from one side and N type impurities are diffused from the other side in a manner common to all diodes. However, in PIN diodes, a barrier layer of undoped silicon is allowed to remain between the doped regions. The barrier layer causes the PIN diodes to be slow in their action compared to regular diodes. Higher frequency applied signals, such as those in the radio frequency ("CRF") and microwave frequencies do not cause the PIN diodes to become forward biased during the positive portion of the signal cycle. In their unbiased states, the PIN diodes have a series resistance of approximately 10 kilo ohms and a small junction capacitance. In their biased state, the PIN diodes have a series resistance of approximately one to two ohms. Resultantly, because of their switching and electrical characteristics, PIN diodes function well in high frequency solid state switch applications.

One particular switch configuration designed to operate in the RF and microwave frequency spectrums uses PIN diodes as series element within the switch. In this configuration, the switch is "closed" when the PIN diodes are forward biased and "open" when the PIN diodes are unbiased. Particular examples of this type of structure are described in U.S. Pat. Nos. 4,525,863 to Stites and 3,475,700 to Ertel. The use of PIN diodes as series elements in a switch, however, causes significant problems. First, forward biasing the PIN diodes introduces DC voltages and transient switching voltages on the signal path. The DC voltages and transient switching voltages feed into the external circuits if not blocked and can damage the external circuits. Second, the junction capacitance of the PIN diodes allows a significant portion of the coupled microwave signal to pass through the switch when the switch is in the "open" position. Therefore, these switches also may provide inferior isolation when the switch is in the "open" position.

Another particular switch configuration that uses PIN diodes, and that is designed to operate in the RF and microwave spectrum, employs PIN diodes with their anodes connected to a transmission line segment that spans from the switch input to the switch output. The cathodes of the PIN diodes are grounded. In the "closed" position, the PIN diodes are unbiased and the coupled signals are allowed to pass from the switch input to the switch output. In the "open" position, the transmission line is biased at a positive DC voltage sufficient to forward bias the PIN diodes therefore causing the PIN diodes to provide a shunt to ground. A significant shortcoming of this switch configuration is that the DC bias voltage is coupled to the transmission line segment. Therefore, DC blocking capacitors must be used as series elements at each end of the transmission line segment to block the DC voltages from entering the coupled circuitry. While the DC blocking capacitors provide satisfactory isolation, they introduce a series impedance in the signal path that attenuates the coupled signal. Typical attenuation caused by the capacitors when the switch is in the "closed" position is between 3 to 3.5 decibels. Because of the high cost of signal amplification in the RF and microwave spectrums, such attenuation is unsatisfactory.

Another particular switch configuration using PIN diodes employs one-quarter wavelength transmission line segments to transform impedances from one portion of the switch to another portion of the switch. The circuit described in U.S. Pat. No. 5,193,218 to Shimo, for example, uses four one-quarter wavelength transmission line segments to provide either very large or very small apparent impedances at junction points on the signal path. When a very large apparent impedance is provided at a point where a quarter wavelength tuning branch joins the main signal path, the signal passes the quarter wavelength branch. However, when the apparent impedance of the quarter wavelength branch is small at the junction point, the signal is shunted along the quarter wavelength branch and does not pass along the signal path.

Switches employing quarter wavelength circuits have significant drawbacks, however. In standard microwave applications, the length of the quarter wavelength segments is large compared to the remainder of the circuit. Therefore, the size of the housing and the length of conductors for the switch is increased compared to other switches. Further, because the wavelength of a signal is inversely proportional to its frequency and because the length of the quarter wavelength lines is fixed, the switch is designed to operate at a single frequency. Therefore, the effectiveness of the quarter wavelength lines, and resultantly the switch, decreases substantially as the frequency of operation varies from the design frequency.

SUMMARY OF THE INVENTION

It is therefore a general object of the invention to overcome the above described limitations, and others, of the prior PIN diode switches. To accomplish these objectives, an inverted PIN diode switch of the present invention comprises generally a first transmission line segment and a second transmission line segment joined by a lumped element network, inductive grounding means for each line segment, a capacitor, PIN diodes, and biasing means. Signals are coupled to the first ends of the first and second transmission line segments via input and output ports respectively.

The lumped element network preferably comprises a plurality of inductive elements and has at least three terminals. A first terminal connects to a second end of the first transmission line segment while a second terminal connects to a second end of the second transmission line segment. A third terminal of the lumped element network connects to an anode of at least one PIN diode. The capacitor is grounded at a first side and connects to the PIN diode cathodes at a second side. Connected in this fashion, the series combination of the lumped element network, the PIN diodes, and the capacitor forms a path to ground that may be used to shunt coupled signals. The biasing means connects to the first side of the capacitor so that it may forward bias the PIN diodes by applying a negative voltage to the second side of the capacitor.

While the switch is in the "closed" position, the PIN diodes are unbiased or reverse biased and provide a high impedance path from the third terminal to ground. Preferably, the switch of the present invention is designed to operate at a design frequency in the range of 12 and 40 GigaHertz. At the design frequency, the input impedance of the lumped element network in the "closed" position at the locations it joins the transmission line segments is substantially equal to the characteristic impedance of the transmission line segment to which it is connected. Therefore, selection of the capacitor, the PIN diodes, and the components comprising the lumped element network is critical. By creating a network whose input impedance matches the characteristic impedance of the associated transmission line segment at the connecting terminals, maximum signal transmission into the network occurs. Further, because the impedance to ground of the PIN diodes when the PIN diodes are unbiased or reverse biased is large, little of the coupled signal is shunted to ground through the series combination of the PIN diodes and capacitor. Therefore maximum signal transmission through the network occurs when the switch is in the "closed" position. If constructed of common components, the PIN diode switch of the present invention has approximately 1.2 decibels of insertion loss while, if constructed of high-grade components, the insertion is as low as 0.5 decibels.

Typically, PIN diodes have a resistance of more than 1,000 ohms when unbiased but between 1 and 2 ohms when biased. Therefore, in the "open" position with the PIN diodes forward biased, the path formed by the combination of the PIN diodes and the capacitor provides a low impedance path to ground for the coupled AC signals. When this low impedance is transferred through the other elements in the network, the apparent impedance at the first and second terminals of the lumped element network is high. Therefore, a significant portion of a signal propagating along the first transmission line segment reflects from the first terminal when it reaches the first terminal. Further, a significant portion of a signal propagating along the second transmission line segment reflects from the second terminal when it reaches the second terminal. Additionally, any signal that does enter the lumped element network is readily shunted to ground through the low impedance path to ground provided by the series combination of the PIN diodes and the capacitor. Therefore, the switch provides significant isolation when in the "open" position. Typically, the switch provides an isolation of 20 decibels at a minimum and in can provide in excess of 50 decibels of isolation, depending upon the configuration of the switch.

The mechanism for biasing the switch of the present invention also provides significant benefits over prior switches. Each of the transmission line segments is fixed at substantially a DC ground voltage by the inductive grounding means connected to the segments. The inductive grounding means provide a very low impedance path to ground for DC and low frequency signals while presenting a very large impedance path to ground for coupled signals in the design frequency range. Because the transmission line segments are held at substantially a DC ground voltage, the biasing means may forward bias the PIN diodes by applying a negative voltage to the first side of the capacitor. Because the biasing voltage is applied to the second side of the capacitor, substantially all of the higher frequency switching transients pass through the capacitor to ground because of the low impedance AC path through the capacitor and because of the AC impedance path through the PIN diode and the lumped element network. Lower frequency switching transients that coupled onto the transmission line segments through the PIN diode and the lumped element network pass readily through the inductive grounding means to ground before exiting the switch.

The configuration of the present invention provides many important advantages over the prior PIN diode switches. Among other advantages, the PIN diode switch of the present invention provides superior isolation in the "open" position, causes little attenuation of the coupled signal when in the "closed" position, and does not allow biasing signals to transmit to the coupled circuits. These and other objects, advantages, and features of the invention will be apparent from the following description of the preferred embodiments, considered along with the accompanying drawings.

DESCRIPTION OF THE PREFERRED EMBODIMENTS

An inverted PIN diode switch embodying the principles of the present invention is shown by way of illustration in FIGS. 1–7.

Figure 1:
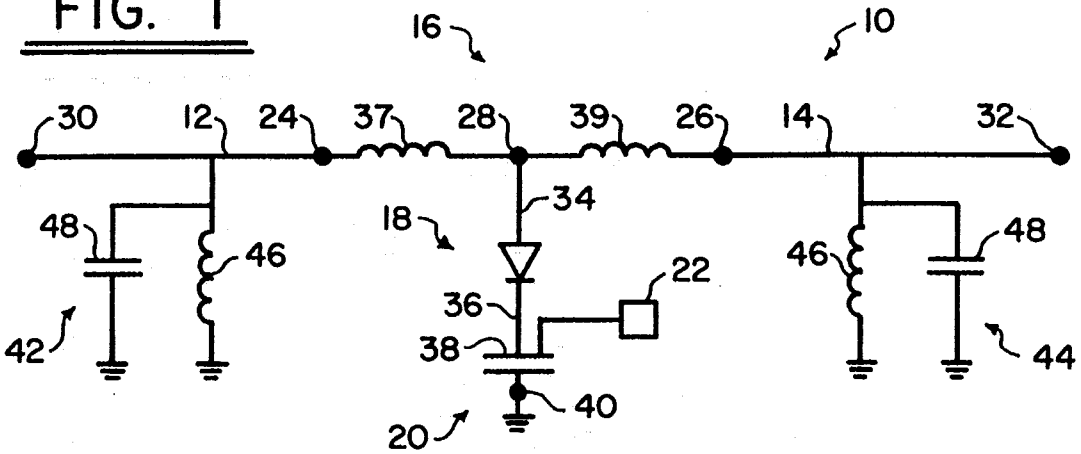
FIG. 1 is an electrical schematic diagram of a first preferred embodiment of an inverted PIN diode switch incorporating the principles of the present invention.

Referring to FIG. 1, a first embodiment of the PIN diode switch 10 of the present invention comprises generally a pair of transmission line segments 12 and 14 joined by a lumped element network 16, at least one PIN diode 18, a capacitor 20, and biasing means 22. The lumped element network 16 comprises at least three terminals, a first terminal 24, a second terminal 26, and a third terminal 28. An input port 30 connects to a first end of the first transmission line segment 12 while an output port 32 connects to a first end of the second transmission line segment 14. Preferably, the first terminal 24 connects to a second end of the first transmission line segment 12 and the second terminal 26 connects to a second end of the second transmission line segment 14. An anode 34 of the PIN diode 18 connects to the third terminal 28 of the lumped element network 16 while a cathode 36 of the PIN diode connects to a second side 38 of the capacitor 20. A first side 40 of the capacitor 20 connects to ground. Preferably, a first lumped inductor 37 connects the first terminal 24 to the third terminal 28 and a second lumped inductor 39 connects the second terminal 26 to the third terminal 28.

A first inductive grounding means 42 fixes the first transmission line segment 12 substantially at a DC ground voltage level but still allows a coupled signal to pass. In an identical fashion, the second inductive grounding means 44 fixes the second transmission line segment 14 substantially at a DC ground voltage level. Typically, the switch of the present invention is designed to operate at a design frequency in the range between 12 and 40 gigahertz and is tuned accordingly. At these frequencies, the first 42 and second 44 inductive grounding means may be modeled as the parallel combination of an inductor 46 and a capacitor 48 shunted to ground. The inductive grounding means 42 and 44 effectively shunt DC and low frequency signals to ground but allow higher frequency signals to pass. Therefore, the first 42 and second 44 inductive grounding means serve to fix the voltage on the transmission line segments 12 and 14 at DC ground while not affecting the transmission of the coupled microwave signals on the segments.

Figure 2:
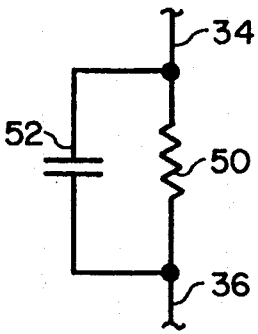
FIG. 2 is an electrical schematic diagram of an equivalent circuit of a PIN diode.

As shown in FIG. 2, the PIN diode 18 may be modelled as the parallel combination of a resistor 50 and a capacitor 52. The capacitor 52 represents the junction capacitance of the PIN diode in the unbiased or reverse biased position and is approximately 0.03 to 0.05 picofarads. The series resistance 50 of the PIN diode 18 is approximately 10 kilo ohms when the diode is unbiased or reverse biased and is approximately one to two ohms when the PIN diode is forward biased.

Referring again to FIG. 1, the biasing means 22, which is for selectively forward biasing the PIN diode cathode 36 at a negative DC voltage, is controllable to allow a user of the switch 10 to control the state of the switch from the "closed" position to the "open" position. Because the first 42 and second 44 inductive grounding means fix the first 12 and second 14 transmission line segments substantially at a DC ground voltage, the biasing means 22 forward biases the PIN diode 18 by applying a negative voltage at the second side 38 of the capacitor 20. Typically, the voltage required to forward bias the PIN diode 18 will be on the order of one to two volts. Circuitry for biasing PIN diodes is well known in the art and is not further described herein.

The main advantage of biasing the switch 10 in the fashion disclosed herein is that high frequency switching transients are substantially shunted to ground through the capacitor 20 and prevented from coupling to the transmission line segments 12 and 14 by the PIN diode 18 and the lumped inductors 37 and 39. As to the lower frequency switching transients that may couple to the transmission line segments 12 and 14 through lumped inductors 37 and 39, the inductive grounding means 42 and 44 effectively shunt the lower frequency switching transients to ground before they may propagate to the input 30 and output 32 ports.

As one skilled in the art will readily appreciate, the absence of DC blocking capacitors in the signal path between the input 30 and output 32 ports substantially reduces the insertion loss (series attenuation) of the switch 10 when in the "closed" position. While the switch of the present invention provides between 0.6 and 1.5 decibels of insertion loss in the "closed" position, prior switches employing DC blocking capacitors have at least 3 decibels of insertion loss when in their "closed" positions.

In order to minimize the insertion loss of the switch 10, the components of the switch must be tuned so that signal transmission is maximized when the switch is in the "closed" position at the design frequency. The values of the lumped inductors 37 and 39, the capacitor 20, and the PIN diode 18 are carefully chosen such that, at a design frequency when the switch is in the "closed" position, the input impedance of the lumped element network 16 at the first terminal 24 substantially equals to the characteristic impedance of the first transmission line segment 12. Further, input impedance of the lumped element network 16 at the second terminal 26 is substantially equals the characteristic impedance of the second transmission line segment 14. Tuning of circuitry of this type is well known in the art and is not more fully described herein.

When the switch 10 is properly tuned at a design frequency, signals coupled to the switch traveling along the first transmission line segment 12 do not reflect at the first terminal and fully transmit into the lumped element network 16. Once within the lumped element network 16, little of the signal is shunted to ground through the PIN diode 18 and the signal almost fully propagates through the second inductor 39 onto the second transmission line segment 14.

When the switch 10 is in "open" position, the PIN diode 18 is forward biased and has a very low series resistance. Therefore, the AC path to ground from the third terminal 28 through the PIN diode 18 and capacitor 20 is small. The low impedance at the third terminal 28, when transformed back to the first 24 and second 26 terminals through inductors 37 and 39 respectively, causes impedance mismatches at the terminals. Thus, signals propagating along the transmission line segments 12 and 14 toward the lumped element network 16 are partially reflected at terminals 24 and 26 respectively. Further, because of the low impedance path through the series combination of the PIN diode 18 and capacitor 20, the portion of the signal entering the lumped element network is almost fully shunted to ground. Combined, the reflection and shunting of the signal causes the isolation of the switch to be large when the switch 10 is in the "open" position. Typically, the switch exhibits isolation of at least 20 decibels.

Figure 3:
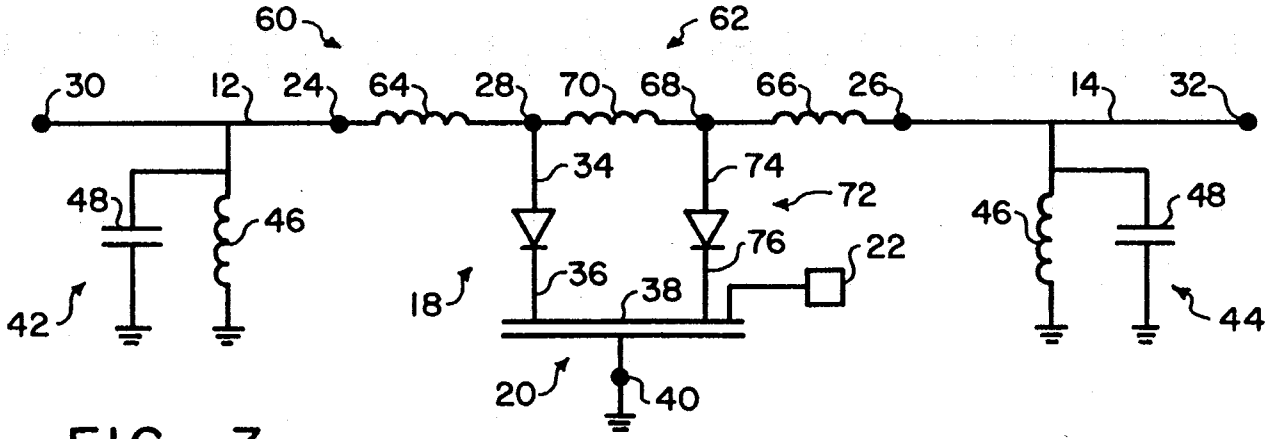
FIG. 3 is an electrical schematic diagram of a second preferred embodiment of an inverted PIN diode switch incorporating the principles of the present invention.

Referring now to FIG. 3, a second preferred embodiment of a switch 60 embodying the principles of the present invention includes all of the components of the switch shown in FIG. 1 as well as additional elements. Those elements common to the two embodiments retain the same numbering convention. In the embodiment of the switch 60 shown in FIG. 3, the lumped element network 62 comprises a first inductor 64 connected at a first end to the first terminal 24 and at a second end to the third terminal 28, a second inductor 66 connected at a first end to the second terminal 26 and at a second end to a fourth terminal 68, and a third inductor 70 connected at a first end to the third terminal 28 and at a second end to the fourth terminal 68. A second PIN diode 72 has an anode 74 connected to the fourth terminal 68 and a cathode 76 connected to the second side 38 of the capacitor 20. Therefore, the biasing means 22 as described in the switch 10 of FIG. 1 forward biases the second PIN diode 72 in the same fashion as it biases the first PIN diode 18. The construction of the lumped element network 62 of this embodiment, while being more complex than the lumped element network 16 of the first embodiment, is easier to properly tune and provides more isolation when the switch 62 is in the "open" position than the switch 10 of the first embodiment. Typically, this embodiment of the switch 60 provides isolation in excess of 45 decibels.

Figure 4:
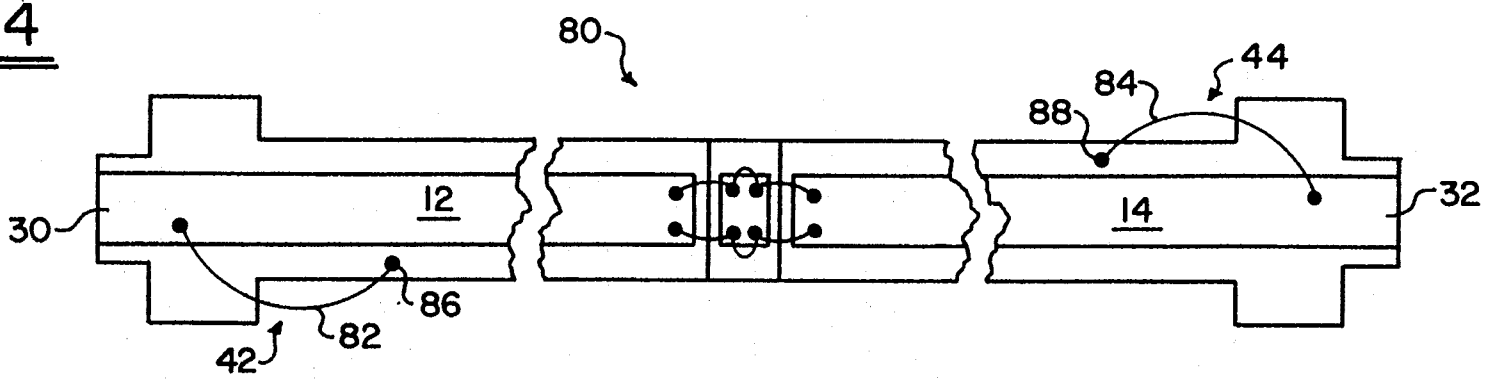
FIG. 4 is a mostly diagrammatic top view of a third preferred embodiment of an inverted PIN diode switch incorporating the principles of the present invention.

Referring now to FIG. 4, a third switch 80 embodying the principles of the present invention is shown substantially in its physical form. The third embodiment of the switch 80 includes all elements of the second embodiment of the switch 60 including additional elements. Therefore, the numbering convention of those elements common to both embodiments is retained. As shown in FIG. 4, the first 12 and second 14 transmission line segments are preferably strip line conductors of a constant width and built as is well known in the art. Preferably, the transmission line segments 12 and 14 have characteristic impedances of 50 ohms and couple to external circuitry (not shown) at the input port 30 and output port 32. Preferably, the first inductive grounding means 42 comprises a section of metal wire 82 having a first end connected to the first transmission line segment 12 and a second end 86 connected to a case ground. The second inductive grounding means 44 has a similar structure with a section of metal wire 84 connected at a first end to the second transmission line section 14 and at a second end to a case ground 88. As is well known in the art, the type and length of the section of metal wire is chosen to optimize the filtering effect of the inductive grounding means (42 or 44) and to minimize the loading effect on the transmission line segments 12 and 14 at higher frequencies. Preferably, the sections of wire 82 and 84 are made of gold or another highly conductive metal. The equivalent inductance of each inductive grounding means is approximately 1 nanohenry while the equivalent capacitance is approximately 0.04 picofarads.

Figure 5:
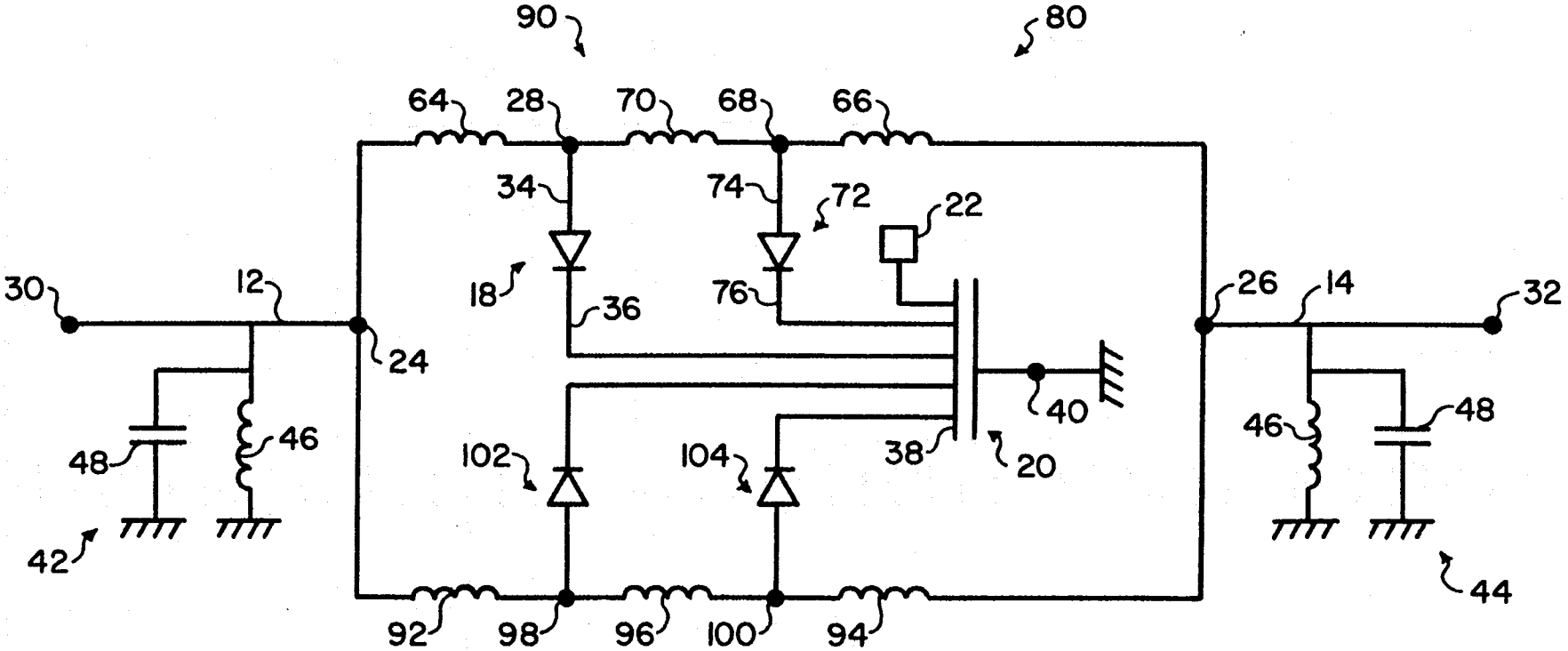
FIG. 5 is an electrical schematic diagram of the inverted PIN diode switch shown in FIG. 4.

Referring now to FIG. 5, an electrical schematic diagram of the third preferred embodiment of the switch 80 is shown. A lumped element network 90 of the switch 80 of a third preferred embodiment includes all of the elements of the lumped element network 62 of the second embodiment and also includes an identical parallel lumped element circuit. The parallel circuit includes fourth 92, fifth 94, and sixth 96 inductive elements. The fourth inductive element 92 connects between the first terminal 24 and a fifth terminal 98. The fifth inductive element 94 connects between the second terminal 26 and a sixth terminal 100. The sixth inductive element connects between the fifth 98 and sixth 100 terminals. A third PIN diode 102 connects to the lumped element circuit 90 with its anode connected to the fifth terminal 98 and with its cathode connected to the second side 38 of the capacitor 20. A fourth PIN diode 104 connects to the lumped element circuit 90 with its anode connected to the sixth terminal 100 and with its cathode connected to the second side 38 of the capacitor 20. Connected in this fashion, the biasing means 22 operates to forward bias all four of the PIN diodes 18, 72, 102, and 104 by fixing the voltage of the second side of the capacitor 38 at a negative voltage.

The construction of the lumped element network 90 of the third embodiment, while being more complex than the lumped element network 16 of the first embodiment or the lumped element network 62 of the second embodiment, is even easier to properly tune and can provide more isolation then the switches of the first and second embodiments 62 in the "open" position and less insertion loss when in the "closed" position. Typically, the switch 80 of the third embodiment provides isolation of at least 50 decibels when constructed of discrete PIN diodes. However, when the switch 80 is constructed of a monolithic, multiple PIN diode unit as is herein described, the isolation of the switch is typically in the 35 to 40 decibel range.

Figure 6:
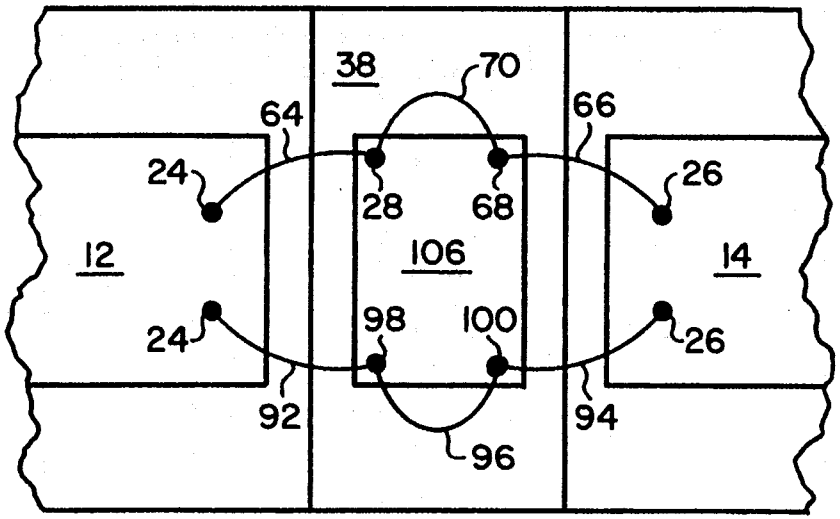
FIG. 6 is a mostly diagrammatic partial top view of the inverted PIN diode switch shown in FIG. 4 detailing the lumped element network, PIN diodes, and capacitor.

Referring now to FIG. 6, a physical construction of the lumped element network 90 of the third embodiment is shown. The inductive elements of the lumped element network 90 preferably each comprise a length of gold wire. The first 64, second 66, fourth 92 and fifth 94 lumped elements preferably each comprise a 0.015 inch section of #50 gold wire. With this length, these segments each have approximately 0.6 nanohenries of inductance. The third 70 and sixth 96 lumped inductive elements preferably each comprise a 0.030 inch section of #50 gold wire. With this length, these segments each have approximately 1.2 nanohenries of inductance. As one skilled in the art will readily appreciate, the length of each of the wire segments may be altered to achieve a desired tuning of the circuit during design as well as during assembly.

Figure 7:
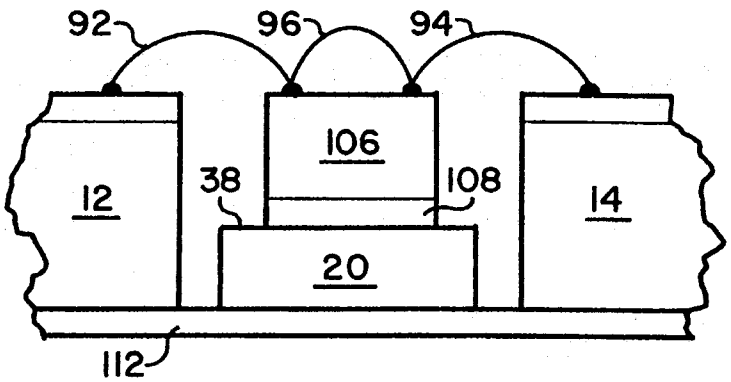
FIG. 7 is a mostly diagrammatic side elevation view of the inverted PIN diode switch shown in FIG. 4 detailing the lumped element network, the PIN diodes, and the capacitor.

As shown in FIGS. 6 and 7, the PIN diodes 18, 72, 102, and 104 preferably are formed in a single structure 106 with a common cathode 108 that is firmly connected to the second side 38 of the capacitor 20. Further, the first side 40 of the capacitor 20 preferably firmly connects to a conductive substrate 112 of a circuit board on which the switch 80 is constructed. The first 12 and second 14 transmission line segments also firmly connect to the circuit board and employ the conductive substrate 112. The construction of circuit boards is well known in the art and is not more fully described herein.

In operation, the switch of the third embodiment operates similarly to the switches of the first and second embodiments. When the switch is "closed", the PIN diodes 18, 72, 102, and 104 are either unbiased or reverse biased. Referring to the PIN diode model of FIG.

2, in the unbiased or reverse biased state, the equivalent shunt resistance of each of the PIN diodes is approximately one kilo ohm and the equivalent junction capacitance of each PIN diode is approximately 0.03 picofarads. Therefore, the PIN diodes provide a high impedance path to ground through the capacitor 20 when unbiased or reverse biased. The lumped inductors of the lumped element networks 16, 62, and 90 are chosen so that the equivalent input impedance of the networks are substantially equal to the characteristic impedance of the transmission line segments 12 and 14. In this fashion, the switches provide maximum transmission of coupled signals in the "closed" position.

In the "open" position, the PIN diodes 18, 72, 102, and 104 are all forward biased by the application of a negative bias voltage to the second side 38 of the capacitor. The biasing means 22 provides a negative bias voltage of approximately one to two volts, such voltage being sufficient to forward bias each of the PIN diodes 18, 72, 102, and 104. When forward biased, the PIN diodes provide high conductance paths to ground at terminals 28, 68, 98, and 100, the impedance at these terminals being transformed through the lumped element inductor to create a high input impedance at both the first 24 and second 26 terminals. This high impedance causes a significant portion of the signal coupled to the first 12 and second 14 transmission line segments to be reflected at the first 24 and second 26 terminals respectively because of the mismatched impedances at those locations. Further, when forward biased, the PIN diodes provide high conductance paths to ground at terminals 28, 68, 98, and 100, these paths serving to shunt substantially all of the coupled signals entering the lumped element network 90. The result of these phenomenon combined is that when the switch is in the "open" position, it provides significant isolation of signals coupled to the switch 80.

The present invention also includes a method for selectively conducting and isolating an electrical signal between an input port 30 and an output port 32. The method of the present invention may be explained through reference to any of the three preferred embodiments of the apparatus of the present invention. Referring particularly to FIG. 1, the method of the present invention comprises as a first step, propagating a signal along a first transmission line segment 12 having a first characteristic impedance. The first transmission line segment 12 is connected at a first end to the input port 30. A next step in the method is fixing the first transmission line segment 12 substantially at a DC ground voltage level. The next step includes coupling the signal to a first terminal 24 of a lumped element network 16, the lumped element network comprising at least two interconnected lumped inductive elements and having at least three terminals. A first terminal 24 connects to a second end of the first transmission line segment 12, a second terminal 26 connects to a second end of a second transmission line segment 14, and a third terminal 28 connects to at least one PIN diode 18 at an anode 34 of each PIN diode. A cathode 36 of each PIN diode 18 connects to a second side 38 of a capacitor 20, the capacitor grounded at a first side 40.

The next step of the :method includes transmitting the signal along the second transmission line segment 14 from the second end of the transmission line segment to the output port 30 that is connected to a first end of the second transmission line segment. Another step includes fixing the second transmission line segment 14 substantially at the DC ground voltage level. A further step includes tuning the lumped element network 16 such that, at a design frequency when each of the PIN diodes 18 is not forward biased, the input impedance of the lumped element network at the first terminal is substantially equal to the first characteristic impedance and the input impedance of the lumped element network at the second terminal 26 is substantially equal to a second characteristic impedance. This step minimizes the insertion loss of the switch 10 at the design frequency when the switch is in the "closed" position. As a final step, the method of the present invention includes selectively forward biasing each of the PIN diode cathodes 36 at a negative DC voltage to forward bias each of the PIN diodes 18 so as to thereby shunt the signal substantially to ground through the PIN diodes and the capacitor 20. This step allows the signal to be substantially isolated from the output port 32 when applied from the input port 30. Such isolation places the switch in the "open" position.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. An inverted PIN diode switch apparatus comprising:

(a) an input port;

(b) an output port;

(c) a first transmission line segment having a first characteristic impedance and connected at a first end to the input port and at a second end to a first terminal;

(d) first inductive grounding means for fixing the first transmission line segment substantially at a DC ground voltage level;

(e) a second transmission line segment having a second characteristic impedance and connected at a first end to the output port and at a second end to a second terminal;

(f) second inductive grounding means for fixing the second transmission line segment substantially at the DC ground voltage level;

(g) a capacitor having a first side and a second side, the capacitor grounded at the first side;

(h) at least four PIN diodes, each PIN diode having an anode and a cathode and each PIN diode cathode connected to a second side of the capacitor, wherein (i) an anode of a first PIN diode connects to a third terminal;

(ii) an anode of a second PIN diode anode connects to a fourth terminal;

(iii) an anode of a third PIN diode connects to a fifth terminal;

(iv) an anode of a fourth PIN diode connects to a sixth terminal;

(i) a lumped element network comprising at least six inductive elements wherein (i) a first inductive element connects at a first end to the first terminal and at a second end to the third terminal;

(ii) a second inductive element connects at a first end to the second terminal and at a second end to the fourth terminal;

(iii) a third inductive element connects at a first end to the third terminal and at a second end to the fourth terminal;

(iv) a fourth inductive element connects at a first end to the first terminal and at a second end to the fifth terminal;

(v) a fifth inductive element connects at a first end to the second terminal and at a second end to a sixth terminal;

(vi) a sixth inductive element connects at a first end to the fifth terminal and at a second end to the sixth terminal;

wherein the inductive elements and the capacitor have values such that, at a design frequency when each of the PIN diodes is not forward biased, the input impedance of the lumped element network at the first terminal is substantially equal to the first characteristic impedance and the input impedance of the lumped element network at the second terminal is substantially equal to the second characteristic impedance; and PIN diode biasing means for selectively biasing each of the PIN diode cathodes at a negative DC voltage to forward bias each of the PIN diodes.

2. The apparatus of claim 1 wherein the first, second, third, fourth, fifth, and sixth inductive elements are formed from sections of wire.

3. The apparatus of claim 2 wherein the first, second, third and fourth PIN diodes are contained in a single structure.

* * * * *